US011669037B2

(12) United States Patent
Suese

(10) Patent No.: US 11,669,037 B2
(45) Date of Patent: Jun. 6, 2023

(54) IMAGE READING APPARATUS CAPABLE OF SELECTING DOCUMENT SHEET CONVEYANCE PROCESS

(71) Applicant: KYOCERA Document Solutions Inc., Osaka (JP)

(72) Inventor: Narihiko Suese, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/654,551

(22) Filed: Mar. 11, 2022

(65) Prior Publication Data

US 2022/0299927 A1 Sep. 22, 2022

(30) Foreign Application Priority Data

Mar. 17, 2021 (JP) ..... JP2021-044025

(51) Int. Cl.
*G03G 15/00* (2006.01)

(52) U.S. Cl.
CPC ..... *G03G 15/6547* (2013.01); *G03G 15/5016* (2013.01); *G03G 15/6552* (2013.01); *G03G 15/6594* (2013.01)

(58) Field of Classification Search
CPC ..... G03G 15/6547; G03G 15/5016; G03G 15/6552; G03G 15/6594
See application file for complete search history.

(56) References Cited

U.S. PATENT DOCUMENTS

2004/0046805 A1* 3/2004 Brand ..... G06F 3/04815 715/848
2010/0097421 A1* 4/2010 Yoshida ..... B41J 11/008 347/14
2011/0058829 A1* 3/2011 Kondo ..... G03G 15/5029 399/45
2011/0211033 A1* 9/2011 Yahata ..... B41J 2/32 347/179
2013/0271544 A1* 10/2013 Yajima ..... B41J 11/70 83/111
2014/0015190 A1* 1/2014 Huang ..... B65H 29/58 271/3.19
2015/0069694 A1* 3/2015 Taki ..... B65H 3/46 271/3.19
2018/0201031 A1* 7/2018 Okumura ..... B65H 1/04

FOREIGN PATENT DOCUMENTS

JP 2006173748 A 6/2006

* cited by examiner

*Primary Examiner* — David H Banh
(74) *Attorney, Agent, or Firm* — Alleman Hall Creasman & Tuttle LLP

(57) ABSTRACT

A sheet conveying device can selectively execute a first conveyance process of conveying sheets on a first tray and discharging the sheets onto a second tray, a second conveyance process of conveying the sheets on the first tray and discharging the sheets onto a third tray, or a third conveyance process of conveying the sheets on the third tray and discharging the sheets onto the second tray. A control device records conveyance history information indicating by which conveyance processes each of the sheets on the first tray has been conveyed in a storage device. Furthermore, the control device causes the sheet conveying device to sequentially select the first conveyance process or the third conveyance process for each of the sheets based on the conveyance history information and execute the selected process.

3 Claims, 4 Drawing Sheets

IMAGE READING APPARATUS CAPABLE OF SELECTING DOCUMENT SHEET CONVEYANCE PROCESS

INCORPORATION BY REFERENCE

This application is based upon and claims the benefit of priority from the corresponding Japanese Patent Application No. 2021-044025 filed on Mar. 17, 2021, the entire contents of which are incorporated herein by reference.

BACKGROUND

The present disclosure relates to a sheet processing control method and a sheet processing apparatus capable of sorting sheets discharged separately to two trays in the original order.

An image reading apparatus often includes a document sheet conveying device and an image reading portion that reads images from document sheets conveyed by the document sheet conveying device. The document sheet conveying device conveys the document sheets stacked on a supply tray one by one along a conveyance path and discharges the document sheets from the conveyance path to a discharge tray.

The document sheets are an example of sheets, and the image reading apparatus is an example of a sheet processing apparatus. The sheet processing apparatus conveys the sheets and executes predetermined sheet processing on the conveyed sheets. In the image reading apparatus, the sheet processing is a process of reading images from the sheets.

In addition, the image reading apparatus is known to detect images of identification codes from the images read from the document sheets conveyed by the document sheet conveying device and to determine whether there are any missing pages in the document sheets based on the result of detection of the identification codes.

SUMMARY

A sheet processing control method according to an aspect of the present disclosure is a method of controlling a sheet processing apparatus. The sheet processing apparatus includes a first tray, a second tray, and a third tray on which sheets can be stacked; a sheet conveying device; and a sheet processing portion. The sheet conveying device is capable of selectively executing a first conveyance process, a second conveyance process, and a third conveyance process. The first conveyance process is a process of conveying the sheets on the first tray one by one along a first conveyance path and then discharging the sheets onto the second tray. The second conveyance process is a process of conveying the sheets on the first tray one by one along a second conveyance path and then discharging the sheets onto the third tray. The third conveyance process is a process of conveying the sheets on the third tray one by one along a third conveyance path and then discharging the sheets onto the second tray. The sheet processing portion is configured to execute a process set in advance on the sheets conveyed by the first conveyance process or the second conveyance process. The sheet processing control method includes executing a first control when a first start event set in advance occurs, the first control causing the sheet conveying device to selectively execute the first conveyance process or the second conveyance process. The sheet processing control method further includes recording conveyance history information in a storage device, the conveyance history information indicating by which of the first conveyance process and the second conveyance process each of the sheets on the first tray has been conveyed in the first control. The sheet processing control method further includes executing a second control when a second start event set in advance occurs, the second control causing the sheet conveying device to sequentially select the first conveyance process or the third conveyance process for each of the sheets based on the conveyance history information and execute the selected process.

A sheet processing apparatus according to another aspect of the present disclosure includes the first tray, the second tray, and the third tray; the sheet conveying device; the sheet processing portion; and a control portion capable of executing a process of the sheet processing control method.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Reading Apparatus 1]

An image reading apparatus 1 is an example of a sheet processing apparatus configured to convey sheets and execute sheet processing on the conveyed sheets. The sheets to be conveyed by the image reading apparatus 1 are document sheets 9 (see FIG. 1) having surfaces on which images are formed.

Figure 1:
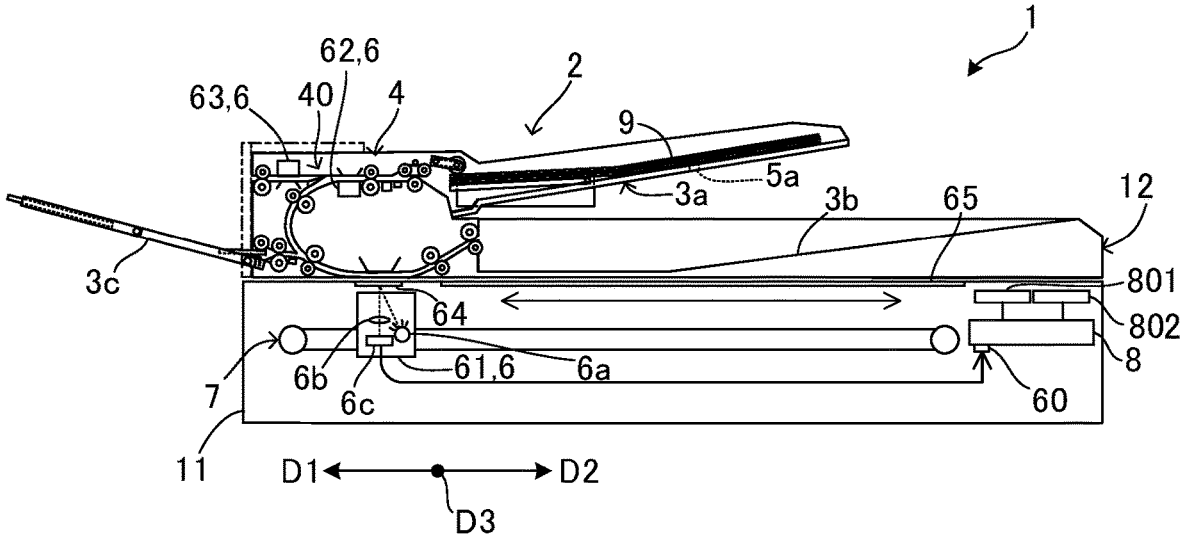
FIG. 1 is a configuration diagram of an image reading apparatus according to an embodiment.

As shown in FIG. 1, the image reading apparatus 1 includes a body portion 11 and a cover portion 12 that covers the upper surface of the body portion 11. The body portion 11 is a housing that houses various types of devices. The cover portion 12 is supported to be displaceable between a closed position at which the cover portion 12 covers the upper surface of the body portion 11 and an open position at which the cover portion 12 opens the upper surface of the body portion 11. The cover portion 12 is displaceably supported by a hinge (not shown) provided for the body portion 11.

The image reading apparatus 1 further includes a contact glass 64 and a platen glass 65 disposed on the upper surface of the body portion 11. The contact glass 64 and the platen glass 65 are transparent plate-like members.

The image reading apparatus 1 further includes a document sheet conveying device 2, an image reading portion 6, a moving mechanism 7, a control device 8, an operation device 801, and a display device 802. The document sheet conveying device 2 is integrated into the cover portion 12.

The document sheet conveying device 2 includes a supply tray 3*a*, a discharge tray 3*b*, a conveyance path 40, a conveying mechanism 4, a supplied document sheet sensor 5*a*, and a conveyed document sheet sensor 5*b*. The conveyance path 40 forms a path along which the document sheets 9 are conveyed.

The document sheets 9 can be stacked on the supply tray 3*a* and the discharge tray 3*b*. The supply tray 3*a* is an example of a first tray, and the discharge tray 3*b* is an example of a second tray. In the present embodiment, the discharge tray 3*b* is disposed below the supply tray 3*a*.

The supplied document sheet sensor 5*a* detects the document sheets 9 placed on the supply tray 3*a*. For example, the supplied document sheet sensor 5*a* includes a first displaceable member and a first detection sensor (both not shown).

The first displaceable member is displaced to a lower position below an upper position serving as an initial position upon receiving the load of the document sheets 9 on the supply tray 3*a*. The first detection sensor detects the first displaceable member displaced to the lower position.

The conveyed document sheet sensor 5*b* detects the document sheets 9 fed from the supply tray 3*a* to the conveyance path 40. For example, the conveyed document sheet sensor 5*b* includes a second displaceable member and a second detection sensor (both not shown).

The second displaceable member is displaced from a reference position to a retracted position by coming into contact with the document sheets 9 fed from the supply tray 3*a* to the conveyance path 40. The second detection sensor detects the second displaceable member displaced to the retracted position.

The conveying mechanism 4 feeds the document sheets 9 on the supply tray 3*a* one by one to the conveyance path 40, conveys the document sheets 9 along the conveyance path 40, and then discharges the document sheets 9 onto the discharge tray 3*b*. The conveying mechanism 4 is an example of a sheet conveying device.

In the description below, a horizontal direction along which the document sheets 9 are fed from the supply tray 3*a* is referred to as "first direction D1", and a direction opposite the first direction D1 is referred to as "second direction D2". In addition, a horizontal direction orthogonal to the first direction D1 and the second direction D2 is referred to as "third direction D3".

Figure 2:
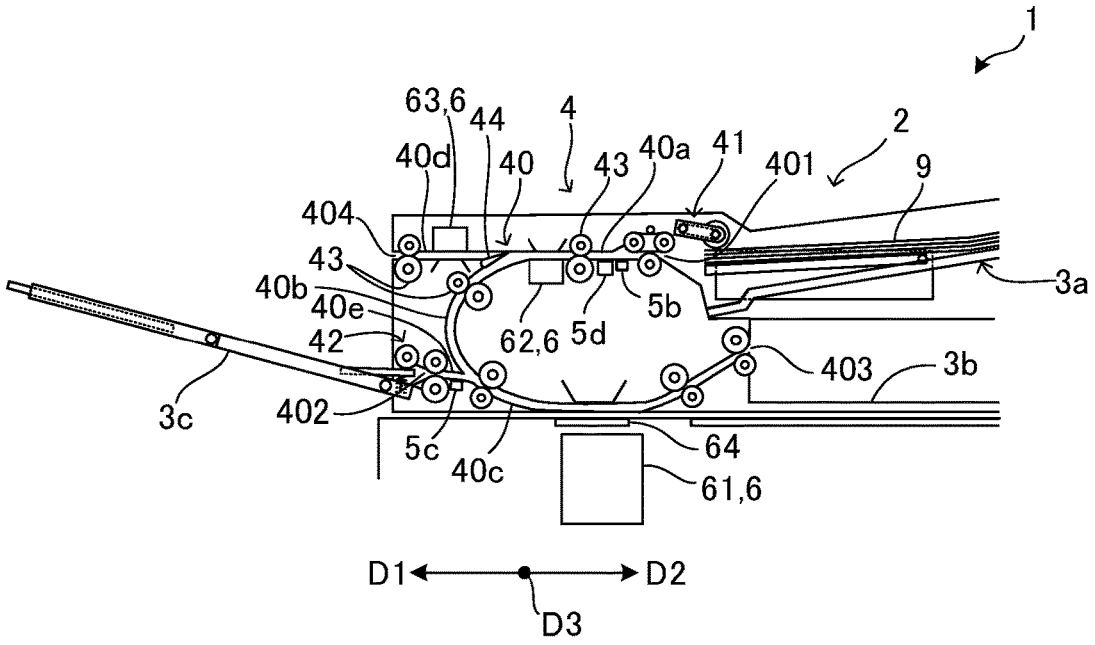
FIG. 2 is a configuration diagram of a main part of the image reading apparatus according to the embodiment.

As shown in FIG. 2, the conveyance path 40 includes a first incoming path 40*a*, a return path 40*b*, and a first outgoing path 40*c*. The first incoming path 40*a* extends from a first entrance 401 corresponding to the supply tray 3*a* in the first direction D1. The conveyed document sheet sensor 5*b* detects the document sheets 9 fed to the first incoming path 40*a*.

The return path 40*b* is a curved path connected to the first incoming path 40*a* and turning back in the second direction D2 opposite the first direction D1. The first outgoing path 40*c* is connected to the return path 40*b* and extends in the second direction D2 to lead to a first exit 403 corresponding to the discharge tray 3*b*. The first outgoing path 40*c* leads to the first exit 403 via a position along the upper surface of the contact glass 64.

The conveying mechanism 4 includes a first feed mechanism 41 corresponding to the supply tray 3*a* and pairs of conveying rollers 43 disposed along the conveyance path 40.

The first feed mechanism 41 feeds the document sheets 9 on the supply tray 3*a* one by one to the first incoming path 40*a*. In the present embodiment, the first feed mechanism 41 feeds the topmost sheet in the document sheets 9 on the supply tray 3*a* to the first incoming path 40*a*.

The pairs of conveying rollers 43 are rotationally driven by motors (not shown) to convey the document sheets 9 along the conveyance path 40.

The image reading portion 6 executes an image reading process of reading images formed on the document sheets 9 and outputting image data representing the read images. In the present embodiment, the image reading portion 6 includes a first image reading portion 61, a second image reading portion 62, and an AFE (Analog Front End) 60.

In the description below, the upper surfaces of the document sheets 9 placed on the supply tray 3*a* are referred to as "first sides", and the lower surfaces of the document sheets 9 placed on the supply tray 3*a* are referred to as "second sides".

The first image reading portion 61 reads images on the first sides of the document sheets 9 passing through the first outgoing path 40*c* while being at a position corresponding to the contact glass 64. The second image reading portion 62 reads images on the second sides of the document sheets 9 passing through the first incoming path 40*a*.

In the present embodiment, the first image reading portion 61 and the second image reading portion 62 each include a light-emitting portion 6*a*, a lens 6*b*, and an image sensor 6*c* (see FIG. 1). The light-emitting portions 6*a*, the lenses 6*b*, and the image sensors 6*c* extend in the third direction D3.

The light-emitting portions 6*a* emit light beams onto document sheets 9. The lenses 6*b* guide the light beams reflected from the document sheets 9 to the respective image sensors 6*c*. The image sensors 6*c* are line sensors that determine the intensity of the light beams reflected from the document sheets 9 and that output detection signals as image signals.

The AFE 60 converts the image signals into digital image data. In the example shown in FIG. 1, the first image reading portion 61 and the second image reading portion 62 are CISs (Contact Image Sensors) each including the light-emitting portion 6*a*, the lens 6*b*, and the image sensor 6*c* of the CMOS (Complementary Metal Oxide Semiconductor) type integrated together.

The moving mechanism 7 moves the first image reading portion 61 in a range from the position facing the contact glass 64 to a position facing the platen glass 65.

In a case where the document sheets 9 are conveyed by the conveying mechanism 4, the moving mechanism 7 keeps the first image reading portion 61 at the position facing the contact glass 64.

In a case where the document sheets 9 are placed on the platen glass 65, the moving mechanism 7 moves the first image reading portion 61 along the platen glass 65. Thus, the image sensor 6*c* of the first image reading portion 61 reads the images on the document sheets 9 while the light-emitting portion 6*a* of the first image reading portion 61 scans the light beam over the document sheets 9 on the platen glass 65.

That is, when the conveying mechanism 4 operates, the image reading portion 6 executes the image reading process on the document sheets 9 conveyed along the conveyance path 40. In contrast, when the conveying mechanism 4 does not operate, the image reading portion 6 executes the image reading process on the document sheets 9 placed on the platen glass 65.

It is noted that the image sensor 6*c* of the first image reading portion 61 may be a CCD (Charge Coupled Device) sensor. In this case, the moving mechanism 7 moves the light-emitting portion 6*a* and the lens 6*b* while the image sensor 6*c* of the CCD type is fixed at a predetermined position.

The operation device 801 is configured to receive operations from users and includes, for example, operation buttons and a touch panel. The display device 802 is configured to display information and includes, for example, a panel display device such as a liquid crystal display unit.

Figure 3:
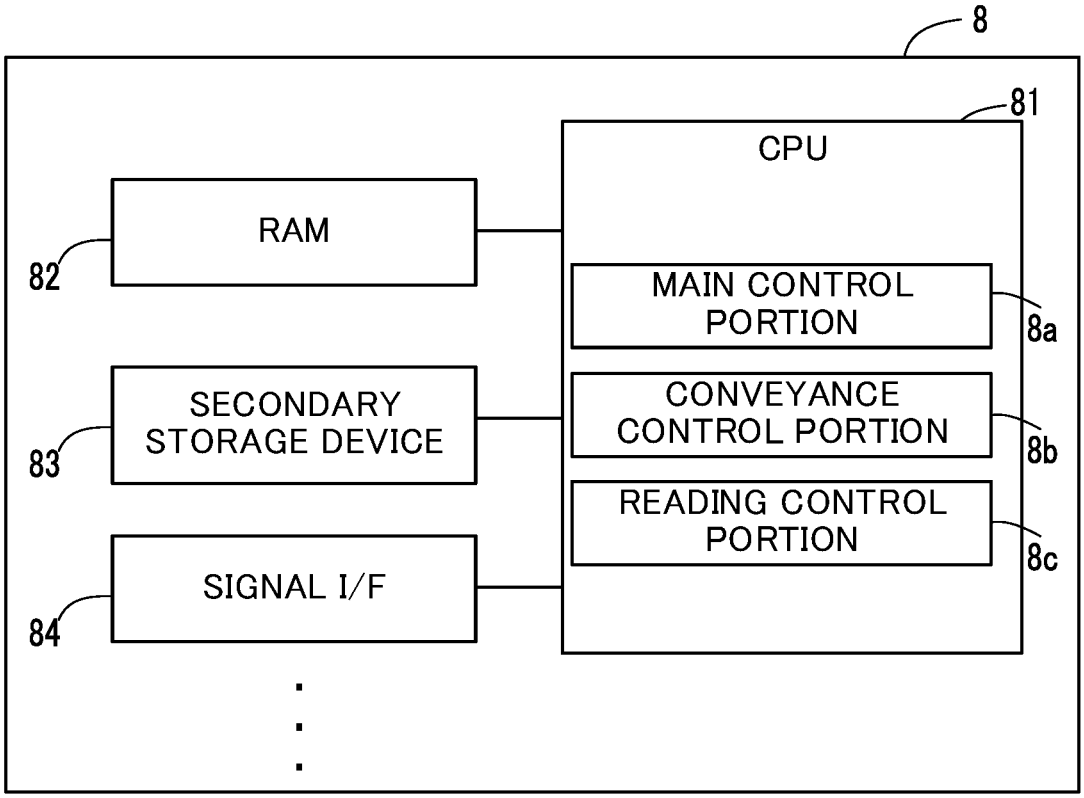
FIG. 3 is a block diagram showing a configuration of a control device in the image reading apparatus according to the embodiment.

The control device 8 executes various types of data processing and controls the image reading apparatus 1. As shown in FIG. 3, the control device 8 includes a CPU (Central Processing Unit) 81, a RAM (Random Access Memory) 82, a secondary storage device 83, and peripherals such as a signal interface 84.

The secondary storage device 83 is a computer-readable nonvolatile storage device. The secondary storage device 83 can store and update computer programs and various types of data. For example, either a flash memory or a hard disk drive, or both, may be adopted as the secondary storage device 83.

The signal interface 84 converts signals output by various types of sensors into digital data and transmits the converted digital data to the CPU 81. Furthermore, the signal interface 84 converts control commands output by the CPU 81 into control signals and transmits the control signals to devices to be controlled.

The CPU 81 is a processor that executes the computer programs to execute various types of data processing and control. The RAM 82 is a computer-readable volatile storage device. The RAM 82 primarily stores the computer programs executed by the CPU 81 and data that is output or consulted by the CPU 81 during execution of various types of processing.

The CPU 81 includes a plurality of processing modules that are implemented when the computer programs are executed. The plurality of processing modules include a main control portion 8*a*, a conveyance control portion 8*b*, and a reading control portion 8*c*.

The main control portion 8*a* executes control that causes various types of processing to be started in response to operations on the operation device 801 and executes control of the display device 802.

The conveyance control portion 8*b* controls the conveying mechanism 4 to control the conveyance of the document sheets 9. The reading control portion 8*c* controls the image reading portion 6 to cause the image reading portion 6 to execute the image reading process.

The conveying mechanism 4 coveys the document sheets 9 along the return path 40*b* on the conveyance path 40. The return path 40*b* is a curved conveyance path along which the conveyance direction of the document sheets 9 is reversed.

For example, when a thick document sheet 9 is conveyed along the return path 40*b*, the document sheet 9 may be damaged. The thick document sheet 9 is an example of a sheet unsuitable for the conveyance along the return path 40*b*.

Accordingly, the sheet processing apparatus such as the image reading apparatus 1 capable of selectively executing a reverse conveyance process or a straight conveyance process can reduce damage to the sheet. In the present embodiment, the document sheet conveying device 2 further includes an auxiliary tray 3*c* (see FIGS. 1 and 2) on which the document sheets 9 can be stacked.

The reverse conveyance process is a process of conveying the document sheets 9 on the supply tray 3*a* to discharge the document sheets 9 onto the discharge tray 3*b* via the return path 40*b*. The straight conveyance process is a process of conveying the document sheets 9 on the supply tray 3*a* along a conveyance path branching off upstream of the return path 40*b* to discharge the document sheets 9 not to the discharge tray 3*b* but to the auxiliary tray 3*c*.

However, in a case where the document sheets 9 stacked on the supply tray 3*a* are discharged separately to the discharge tray 3*b* and the auxiliary tray 3*c*, sorting the document sheets 9 stacked on the two different trays in the original order is time consuming.

The conveying mechanism 4 of the image reading apparatus 1 has a configuration capable of selectively executing the reverse conveyance process or the straight conveyance process. Furthermore, the image reading apparatus 1 has a function of sorting the document sheets 9 discharged separately to the discharge tray 3*b* and the auxiliary tray 3*c* in the original order.

As shown in FIGS. 1 and 2, the auxiliary tray 3*c* are disposed at a position away from the supply tray 3*a* and the discharge tray 3*b* in the first direction D1. The auxiliary tray 3*c* is an example of a third tray. For example, the auxiliary tray 3*c* may be collapsible along the outer edge of the cover portion 12.

The conveyance path 40 further includes a second outgoing path 40*d* and a second incoming path 40*e*. The second outgoing path 40*d* is connected to the first incoming path 40*a* and extends in the first direction D1 to lead to a second exit 404 corresponding to the auxiliary tray 3*c*. That is, the conveyance path 40 branches off from the first incoming path 40*a* to the return path 40*b* and the second outgoing path 40*d*.

The second incoming path 40*e* extends from a second entrance 402 corresponding to the auxiliary tray 3*c* in the second direction D2 to be connected to the first outgoing path 40*c*. That is, the return path 40*b* and the second incoming path 40*e* join the first outgoing path 40*c*.

The conveying mechanism 4 further includes a path switching mechanism 44 and a second feed mechanism 42. In addition, the document sheet conveying device 2 further includes a conveyed document sheet sensor 5*c* (see FIG. 2) corresponding to the second feed mechanism 42. In addition, the image reading apparatus 1 further includes a third image reading portion 63 partly constituting the image reading portion 6.

The path switching mechanism 44 selectively guides the document sheets 9 conveyed along the first incoming path 40*a* to either the return path 40*b* or the second outgoing path 40*d*.

The second feed mechanism 42 feeds the document sheets 9 on the auxiliary tray 3*c* one by one to the second incoming path 40*e*. In the present embodiment, the second feed mechanism 42 feeds the topmost sheet in the document sheets 9 on the auxiliary tray 3*c* to the second incoming path 40*e*.

The conveyed document sheet sensor 5*c* detects the document sheets 9 fed from the auxiliary tray 3*c* to the second incoming path 40*e*. The conveyed document sheet sensor 5*c* has a configuration identical to that of the conveyed document sheet sensor 5*b* corresponding to the first feed mechanism 41.

In the description below, part of the conveyance path 40 from the first incoming path 40*a* to the first outgoing path 40*c* via the return path 40*b* is referred to as "first conveyance path 40*a*-40*c*". Moreover, part of the conveyance path 40 from the first incoming path 40*a* to the second outgoing path 40*d* is referred to as "second conveyance path 40*a*-40*d*". In addition, part of the conveyance path 40 from the second incoming path 40*e* to the first outgoing path 40*c* is referred to as "third conveyance path 40*e*-40*c*".

The conveying mechanism 4 can perform a first operation of guiding the document sheets 9 to the return path 40*b* using the path switching mechanism 44 while operating the first feed mechanism 41 and the pairs of conveying rollers 43.

Moreover, the conveying mechanism 4 can perform a second operation of guiding the document sheets 9 to the second outgoing path 40*d* using the path switching mechanism 44 while operating the first feed mechanism 41 and the pairs of conveying rollers 43.

Furthermore, the conveying mechanism 4 can perform a third operation of operating the second feed mechanism 42 and the pairs of conveying rollers 43.

The conveying mechanism 4 performs the first operation to execute a first conveyance process of conveying the document sheets 9 on the supply tray 3*a* one by one along the first conveyance path 40*a*-40*c* and then discharging the document sheets 9 onto the discharge tray 3*b*. The first conveyance process corresponds to the reverse conveyance process.

In addition, the conveying mechanism 4 performs the second operation to execute a second conveyance process of conveying the document sheets 9 on the supply tray 3*a* one by one along the second conveyance path 40*a*-40*d* and then discharging the document sheets 9 onto the auxiliary tray 3*c*. The second conveyance process corresponds to the straight conveyance process.

The third image reading portion 63 reads images on the first sides of the document sheets 9 passing through the second outgoing path 40*d*. The third image reading portion 63 has a configuration identical to that of the second image reading portion 62.

In addition, the conveying mechanism 4 performs the third operation to execute a third conveyance process of conveying the document sheets 9 on the auxiliary tray 3*c* one by one along the third conveyance path 40*e*-40*c* and then discharging the document sheets 9 onto the discharge tray 3*b*.

The conveying mechanism 4 can selectively execute the first conveyance process, the second conveyance process, or the third conveyance process according to the control by the conveyance control portion 8*b*.

The image reading apparatus 1 further includes a thickness sensor 5*d* (see FIG. 2). The thickness sensor 5*d* determines the thicknesses of the document sheets 9 conveyed along the first incoming path 40*a*. For example, the thickness sensor 5*d* determines the capacitances of the document sheets 9. The document sheets 9 with higher capacitances have greater thicknesses.

The main control portion 8*a* starts a reading control in a sorting mode (see FIG. 4) when a predetermined first start event occurs. For example, the first start event is an event where a predetermined start operation performed on the operation device 801 is detected while the document sheets 9 on the supply tray 3*a* are detected by the supplied document sheet sensor 5*a*.

The reading control in the sorting mode includes causing the conveying mechanism 4 to convey the document sheets 9 and causing the image reading portion 6 to execute the image reading process.

[Reading Control in Sorting Mode]

Figure 4:
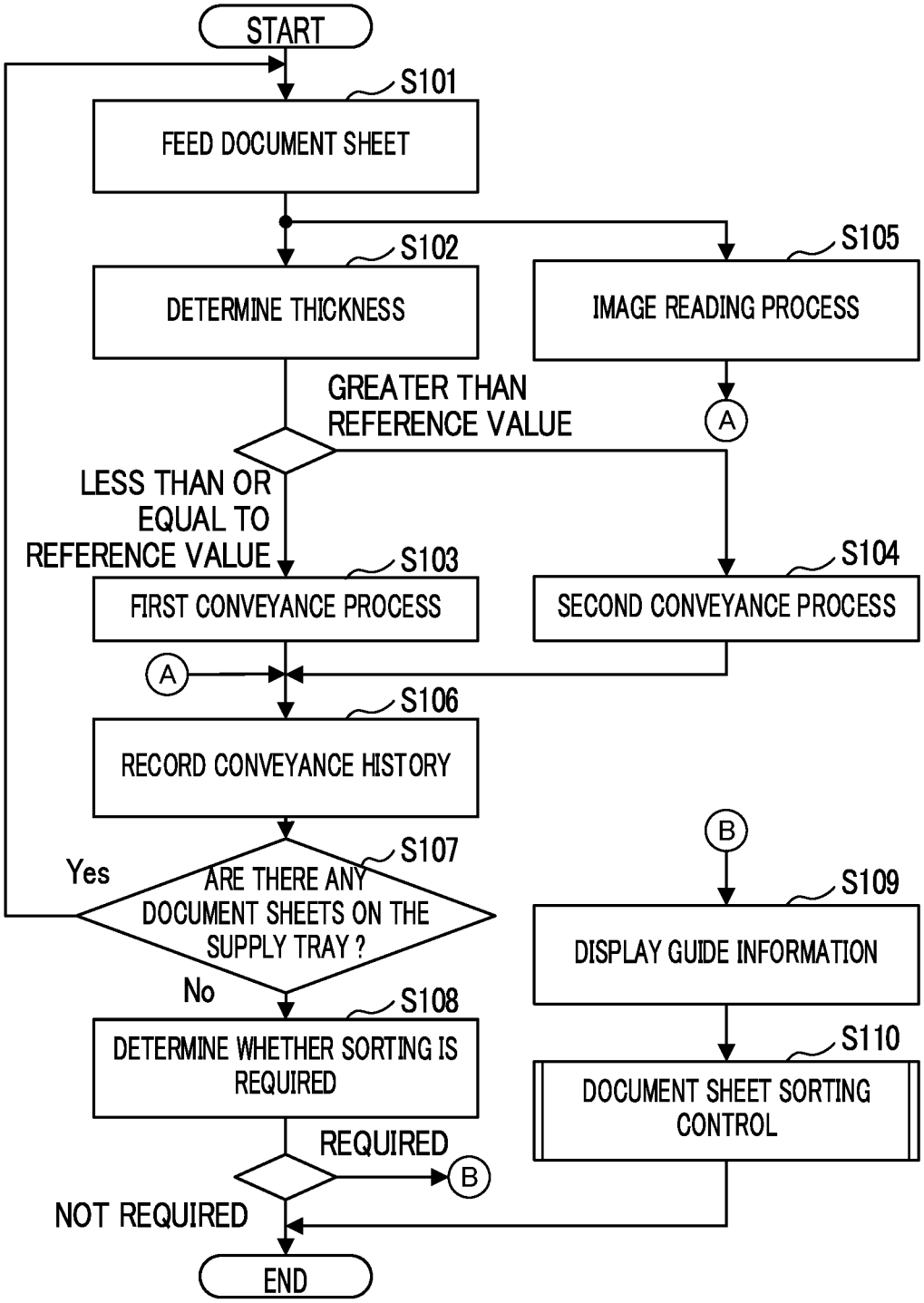
FIG. 4 is a flowchart showing an example of a procedure of a reading control in a sorting mode in the image reading apparatus according to the embodiment.

The following describes an example of a procedure of the reading control in the sorting mode with reference to a flowchart shown in FIG. 4. The reading control in the sorting mode is an embodiment of a sheet processing control method.

In the following description, S101, S102, . . . are identification signs representing a plurality of steps in the reading control in the sorting mode. In the reading control in the sorting mode, a process in step S101 is started first.

<Step S101>

In step S101, the conveyance control portion 8*b* causes the first feed mechanism 41 to feed a document sheet 9 and then moves the process to step S102. In addition, the reading control portion 8*c* executes a process in step S105 while the conveyance control portion 8*b* executes processes in steps S102 to S104.

<Step S102>

In step S102, the conveyance control portion 8*b* determines whether the thickness of the document sheet 9 is less than or equal to a predetermined reference value or exceeds the reference value based on the value determined by the thickness sensor 5*d*.

Upon determining that the thickness of the document sheet 9 is less than or equal to the reference value, the conveyance control portion 8*b* moves the process to step S103. Otherwise, the conveyance control portion 8*b* moves the process to step S104.

<Step S103>

In step S103, the conveyance control portion 8*b* causes the conveying mechanism 4 to execute the first conveyance process. Specifically, the conveyance control portion 8*b* controls the path switching mechanism 44 such that the document sheet 9 is guided to the return path 40*b*. Subsequently, the conveyance control portion 8*b* moves the process to step S106.

<Step S104>

In step S104, the conveyance control portion 8*b* causes the conveying mechanism 4 to execute the second conveyance process. Specifically, the conveyance control portion 8*b* controls the path switching mechanism 44 such that the document sheet 9 is guided to the second outgoing path 40*d*. Subsequently, the conveyance control portion 8*b* moves the process to step S106.

As described above, the conveyance control portion 8*b* executes the control in steps S102 to S104 when the first start event occurs. The control in steps S102 to S104 is an example of a first control that causes the conveying mechanism 4 to selectively execute the first conveyance process or the second conveyance process.

In addition, in the first control, the conveyance control portion 8*b* selects which of the first conveyance process and the second conveyance process is to be executed by the conveying mechanism 4 (step S102) based on the result of determination by the thickness sensor 5*d*.

<Step S105>

In step S105, the reading control portion 8*c* causes the image reading portion 6 to execute the image reading process. Subsequently, the reading control portion 8*c* moves the process to step S106.

In a case where the first conveyance process is executed while a two-sided reading mode is selected as an operation mode in advance, the reading control portion 8*c* causes the second image reading portion 62 and the first image reading portion 61 to sequentially execute the image reading process.

In a case where the second conveyance process is executed while the two-sided reading mode is selected as the operation mode in advance, the reading control portion 8*c* causes the second image reading portion 62 and the third image reading portion 63 to sequentially execute the image reading process.

In a case where the first conveyance process is executed while a one-sided reading mode is selected as the operation mode in advance, the reading control portion 8*c* causes the first image reading portion 61 to execute the image reading process.

In a case where the second conveyance process is executed while the one-sided reading mode is selected as the operation mode in advance, the reading control portion 8*c* causes the third image reading portion 63 to execute the image reading process.

The reading control portion 8*c* controls the timing at which the image reading portion 6 is to be operated based on the timing at which the conveyed document sheet sensor 5*b* changes its state from "not detecting the document sheet 9" to "detecting the document sheet 9". Furthermore, the reading control portion 8*c* controls the timing at which the image reading portion 6 is to be stopped based on the timing at which the conveyed document sheet sensor 5*b* changes its state from "detecting the document sheet 9" to "not detecting the document sheet 9".

The image reading portion 6 is an example of a sheet processing portion that executes predetermined processes on the sheet conveyed by the first conveyance process or the second conveyance process.

<Step S106>

In step S106, the conveyance control portion 8*b* records conveyance history information in the secondary storage device 83 and moves the process to step S107.

The conveyance history information indicates by which of the first conveyance process and the second conveyance process each document sheet 9 on the supply tray 3*a* has been conveyed in the control in steps S102 to S104.

For example, the conveyance history information includes total count information and document sheet number information. The total count information indicates the total number of document sheets 9 fed by the first feed mechanism 41 after the occurrence of the first start event. The document sheet number information indicates the ordinal positions of the document sheets 9 subjected to the first conveyance process.

The conveyance control portion 8*b* counts the number of document sheets 9 fed by the first feed mechanism 41 by counting the number of changes in the state of the conveyed document sheet sensor 5*b* occurring when the conveyed document sheet sensor 5*b* detects the document sheets 9.

<Step S107>

In step S107, the conveyance control portion 8*b* determines whether there are any document sheets 9 on the supply tray 3*a* based on the detection state of the supplied document sheet sensor 5*a*. Upon determining that there is one or more document sheets 9 on the supply tray 3*a*, the conveyance control portion 8*b* moves the process to step S101. Otherwise, the conveyance control portion 8*b* moves the process to step S108.

<Step S108>

In step S108, the conveyance control portion 8*b* determines whether the document sheets 9 need to be sorted based on the conveyance history information.

Specifically, the conveyance control portion 8*b* determines that the document sheets 9 do not need to be sorted in a case where the conveyance history information indicates that all the document sheets 9 are conveyed by the first conveyance process. Otherwise, the conveyance control portion 8*b* determines that the document sheets 9 need to be sorted.

Upon determining that the document sheets 9 do not need to be sorted, the conveyance control portion 8*b* ends the reading control in the sorting mode. Otherwise, the conveyance control portion 8*b* moves the process to step S109.

<Step S109>

In step S109, the main control portion 8*a* displays guide information in the display device 802. The guide information indicates operations to be performed by users before document sheet sorting control (described later) starts.

The guide information includes information that prompts the users to perform an operation for starting the document sheet sorting control. In the present embodiment, the main control portion 8*a* changes the information included in the guide information according to the content of the conveyance history information.

Specifically, in a case where the conveyance history information indicates that a part of the document sheets 9 is conveyed by the first conveyance process in the control in steps S102 to S104, the main control portion 8*a* includes document sheet moving guide information in the guide information. The document sheet moving guide information provides guidance on how one or more document sheets 9 on the discharge tray 3*b* are moved onto the supply tray 3*a*.

The leading edges of the document sheets 9 on the discharge tray 3*b* face a direction opposite the direction the leading edges of the document sheets 9 on the supply tray 3*a* face, and the first sides of the document sheets 9 on the discharge tray 3*b* face a direction opposite the direction the first sides of the document sheets 9 on the supply tray 3*a* face. In addition, compared with the document sheets 9 on the supply tray 3*a*, the document sheets 9 stacked on the discharge tray 3*b* are stacked in reverse order from bottom to top.

The leading edges of the document sheets 9 on the auxiliary tray 3*c* face the same direction as the leading edges of the document sheets 9 on the supply tray 3*a*, and the first sides of the document sheets 9 on the auxiliary tray 3*c* face the same direction as the first sides of the document sheets 9 on the supply tray 3*a*. In addition, compared with the document sheets 9 on the supply tray 3*a*, the document sheets 9 stacked on the auxiliary tray 3*c* are stacked in reverse order from bottom to top.

In the above-described case, the document sheet moving guide information provides guidance on moving the document sheets 9 on the discharge tray 3*b* onto the supply tray 3*a* without changing the direction the leading edges face and the direction the first sides face.

In addition, the main control portion 8*a* may include information that provides guidance on not changing the directions the document sheets 9 on the auxiliary tray 3*c* face in the guide information. Furthermore, the main control portion 8*a* may include information that prompts the users to align the edges of the document sheets 9 on the auxiliary tray 3*c* facing the second direction D2 to the position of the second feed mechanism 42 in the guide information.

The process in step S109 is executed at a point in time after the control in steps S102 to S104 has started and before the document sheet sorting control (described later) starts.

After displaying the guide information in the display device 802, the main control portion 8*a* moves the process to step S110.

<Step S110>

In step S110, the conveyance control portion 8*b* executes the document sheet sorting control when a predetermined second start event occurs. In the present embodiment, the second start event is an event where an operation for starting the document sheet sorting control is performed on the operation device 801.

After executing the document sheet sorting control, the conveyance control portion 8*b* ends the reading control in the sorting mode.

[Document Sheet Sorting Control]

Figure 5:
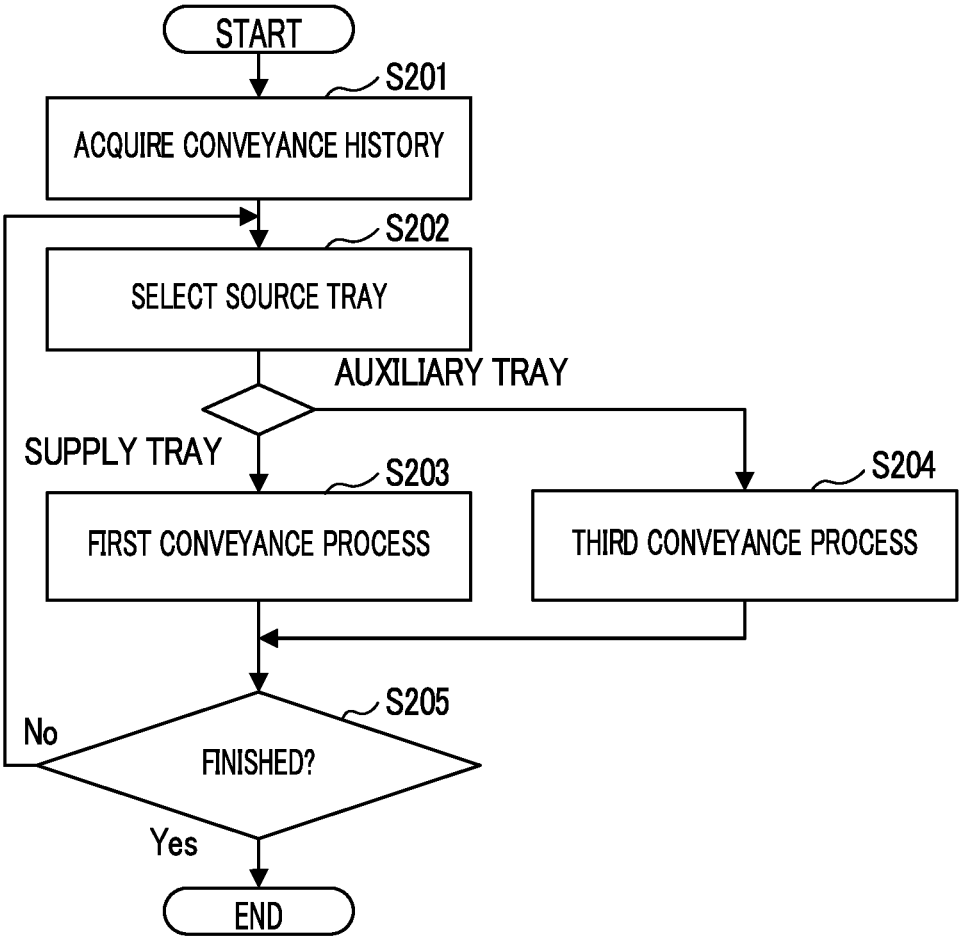
FIG. 5 is a flowchart showing an example of a procedure of a document sheet sorting control in the image reading apparatus according to the embodiment.

The following describes an example of a procedure of the document sheet sorting control with reference to a flowchart shown in FIG. 5.

In the following description, S201, S202, . . . are identification signs representing a plurality of steps in the document sheet sorting control. In the document sheet sorting control, a process in step S201 is started first.

<Step S201>

In step S201, the conveyance control portion 8*b* acquires the conveyance history information from the secondary storage device 83. Subsequently, the conveyance control portion 8*b* moves the process to step S202.

<Step S202>

In step S202, the conveyance control portion 8*b* selects either the supply tray 3*a* or the auxiliary tray 3*c* as a source tray according to a predetermined selection rule based on the conveyance history information. The source tray is a tray from which the document sheets 9 are fed in step S203 or S204.

The selection rule is established such that the document sheets 9 stacked on the supply tray 3*a* and the auxiliary tray 3*c* are stacked on the discharge tray 3*b* in the original page order when the document sheets 9 are conveyed to the discharge tray 3*b*. The original page order corresponds to the page order of the document sheets 9 on the supply tray 3*a* when the reading control in the sorting mode starts.

The conveyance control portion 8*b* moves the process to step S203 upon selecting the supply tray 3*a* as the source tray, whereas the conveyance control portion 8*b* moves the process to step S204 upon selecting the auxiliary tray 3*c* as the source tray.

<Step S203>

In step S203, the conveyance control portion 8*b* causes the conveying mechanism 4 to execute the first conveyance process and then moves the process to step S205. The control in step S203 causes the topmost sheet in the document sheets 9 on the supply tray 3*a* to be conveyed to the discharge tray 3*b*.

<Step S204>

In step S204, the conveyance control portion 8*b* causes the conveying mechanism 4 to execute the third conveyance process and then moves the process to step S205. The control in step S204 causes the topmost sheet in the document sheets 9 on the auxiliary tray 3*c* to be conveyed to the discharge tray 3*b*.

<Step S205>

In step S205, the conveyance control portion 8*b* determines whether an end condition that indicates all the document sheets 9 on the supply tray 3*a* and the auxiliary tray 3*c* have been conveyed is achieved.

For example, the conveyance control portion 8*b* determines that the end condition is achieved when the number of times the first conveyance process in step S203 and the third conveyance process in step S204 are executed reaches the total number in the conveyance history information.

Upon determining that the end condition is achieved, the conveyance control portion 8*b* ends the sorting control. Otherwise, the conveyance control portion 8*b* moves the process to step S202.

The control in steps S202 to S205 by the conveyance control portion 8*b* is an example of a second control that causes the conveying mechanism 4 to sequentially select the first conveyance process or the third conveyance process for each of the document sheets 9 based on the conveyance history information and execute the selected process when the second start event occurs.

The adoption of the image reading apparatus 1 allows the document sheet conveying device 2 to sort the document sheets 9 discharged separately to two trays in the original order with a simple operation.

First Application Example

The following describes a sheet processing apparatus according to a first application example of the image reading apparatus 1. The sheet processing apparatus according to the present application example may have a configuration in which the image reading portion 6 in the image reading apparatus 1 is replaced with another sheet processing portion.

For example, instead of the image reading portion 6, the sheet processing portion may be a punching mechanism that punches holes in the sheets conveyed by the conveying mechanism 4. The sheet processing apparatus according to the present application example produces effects similar to those produced by the image reading apparatus 1.

Second Application Example

Next, the following describes a sheet processing apparatus according to a second application example of the image reading apparatus 1. In the present application example, the main control portion 8*a* sets specific information indicating the ordinal positions of the document sheets 9 that are to be subjected to the second conveyance process based on specific operations on the operation device 801.

Furthermore, in step S102 in FIG. 4, the conveyance control portion 8*b* according to the present application example selects which of the first conveyance process and the second conveyance process is to be executed by the conveying mechanism 4 based on the specific information.

The sheet processing apparatus according to the present application example produces effects similar to those produced by the image reading apparatus 1.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image reading apparatus comprising:

a first tray on which document sheets can be stacked;

a second tray which is disposed below the first tray and on which the document sheets can be stacked;

a third tray which is disposed at a position away from the first tray and the second tray in a horizontal first direction and on which the document sheets can be stacked;

a first conveyance path including: a first incoming path extending from a first entrance corresponding to the first tray in the first direction; a return path connected to the first incoming path and turning back in a second direction opposite the first direction; and a first outgoing path connected to the return path and extending in the second direction to lead to a first exit corresponding to the second tray;

a second conveyance path including: the first incoming path; and a second outgoing path connected to the first incoming path and extending in the first direction to lead to a second exit corresponding to the third tray;

a third conveyance path including: a second incoming path extending from a second entrance corresponding to the third tray in the second direction to be connected to the first outgoing path; and the first outgoing path;

a document sheet conveying device capable of selectively executing a first conveyance process of conveying the document sheets on the first tray one by one along the first conveyance path and then discharging the document sheets onto the second tray, a second conveyance process of conveying the document sheets on the first tray one by one along the second conveyance path and then discharging the document sheets onto the third tray, or a third conveyance process of conveying the document sheets on the third tray one by one along the third conveyance path and then discharging the document sheets onto the second tray;

an image reading portion configured to execute an image reading process for reading images from the document sheets conveyed by the first conveyance process or the second conveyance process; and a control portion configured to control the document sheet conveying device, wherein the control portion executes a first control when a first start event set in advance occurs, the first control causing the document sheet conveying device to selectively execute the first conveyance process or the second conveyance process;

the control portion further records conveyance history information in a storage device, the conveyance history information indicating by which of the first conveyance process and the second conveyance process each of the document sheets on the first tray has been conveyed in the first control; and the control portion further executes a second control when a second start event set in advance occurs after the first control is executed, the second control causing the document sheet conveying device to sequentially select the first conveyance process or the third conveyance process for each of the document sheets based on the conveyance history information and execute the selected process.

2. The image reading apparatus according to claim 1, further comprising:

a thickness sensor configured to determine a thickness of each of the document sheets conveyed along the first incoming path, wherein in the first control, the control portion selects which of the first conveyance process and the second conveyance process is to be executed by the document sheet conveying device based on a result of determination by the thickness sensor.

3. The image reading apparatus according to claim 1, further comprising a display device, wherein the control portion causes the display device to display information at a point in time after the first control starts and before the second control starts, the information providing guidance on how one or more of the document sheets on the second tray are moved onto the first tray.

* * * * *